US008109510B2

(12) United States Patent
Sugiyama et al.

(10) Patent No.: US 8,109,510 B2
(45) Date of Patent: Feb. 7, 2012

(54) SHEET INVERTING AND CONVEYING MECHANISM AND SHEET INVERTING AND CONVEYING APPARATUS

(75) Inventors: Yoshihide Sugiyama, Kinokawa (JP); Kazuya Yamamoto, Kinokawa (JP)

(73) Assignee: Duplo Seiko Corporation, Kinokawa-Shi, Wakayama (JP)

( * ) Notice: Subject to any disclaimer, the term of this patent is extended or adjusted under 35 U.S.C. 154(b) by 94 days.

(21) Appl. No.: 12/278,690

(22) PCT Filed: Mar. 5, 2007

(86) PCT No.: PCT/JP2007/054165

§ 371 (c)(1),
(2), (4) Date: Aug. 7, 2008

(87) PCT Pub. No.: WO2007/105509

PCT Pub. Date: Sep. 20, 2007

(65) Prior Publication Data

US 2009/0051104 A1 Feb. 26, 2009

(30) Foreign Application Priority Data

Mar. 10, 2006 (JP) ..... 2006-066143

(51) Int. Cl.
*B65H 5/02* (2006.01)

(52) U.S. Cl. ..... 271/276; 271/225

(58) Field of Classification Search ..... 271/3.18, 271/3.21, 3.22, 3.23, 225, 275, 276, 184, 271/185, 186; 193/44–48; 198/406, 407, 198/402; 399/401, 364, 374

See application file for complete search history.

(56) References Cited

U.S. PATENT DOCUMENTS 3,856,132 A * 12/1974 Sakurai et al. ..... 198/457.05
4,019,435 A * 4/1977 Davis ..... 101/232
4,078,489 A 3/1978 Davis
4,687,193 A * 8/1987 Scarabino et al. ..... 271/184
4,947,981 A * 8/1990 Dorner et al. ..... 198/360
6,227,532 B1 * 5/2001 Bakoledis ..... 271/9.13

(Continued)

FOREIGN PATENT DOCUMENTS

JP 56-023161 A 3/1981

(Continued)

OTHER PUBLICATIONS

PCT/ISA/210 (International Search Report).

(Continued)

*Primary Examiner* — Jeremy R Severson
(74) *Attorney, Agent, or Firm* — Buchanan Ingersoll & Rooney PC

(57) ABSTRACT

There is provided a sheet inverting and conveying mechanism for conveying a sheet in a first direction, inverting obverse and reverse sides of the sheet, and then conveying the inverted sheet in a second direction. The mechanism includes: a first conveyance section for receiving, at its conveyance face, one side of the sheet, and for conveying the sheet in the first direction; a sheet inverting section for receiving, at its bent inner peripheral face, one side of the sheet, and for inverting the sheet while bending the sheet along the bent inner peripheral face; and a second conveyance section for receiving, at its conveyance face, one side of the inverted sheet, and for conveying the sheet in the second direction, wherein the first conveyance section and the second conveyance section are formed so that the sheet is conveyed while being attracted to the conveyance faces.

7 Claims, 14 Drawing Sheets

U.S. PATENT DOCUMENTS

| | | | | |
|---|---|---|---|---|
| 6,460,842 | B1 * | 10/2002 | Koelle | 270/58.01 |
| 6,477,950 | B1 * | 11/2002 | Feilen et al. | 101/230 |
| 6,767,013 | B2 * | 7/2004 | Lehmann | 271/186 |
| 7,530,442 | B2 * | 5/2009 | Gerke et al. | 198/402 |
| 7,766,322 | B2 * | 8/2010 | Nakamura et al. | 271/184 |
| 2006/0071414 | A1 * | 4/2006 | Kawatsu et al. | 271/225 |
| 2009/0066015 | A1 * | 3/2009 | Sugiyama et al. | 271/225 |

FOREIGN PATENT DOCUMENTS

| | | | | |
|---|---|---|---|---|
| JP | 56-122761 | A | | 9/1981 |
| JP | 22751/1982 | U | | 2/1982 |
| JP | 62-200640 | U | | 12/1987 |
| JP | 02-061658 | A | | 3/1990 |
| JP | 03-162350 | A | | 7/1991 |
| JP | 04-041359 | A | | 2/1992 |
| JP | 06032488 | A | * | 2/1994 |
| JP | 2004-001290 | A | | 1/2004 |
| JP | 2004-043111 | A | | 2/2004 |
| JP | 2005-029375 | | | 2/2005 |

OTHER PUBLICATIONS

Japanese Office Action dated Sep. 14, 2010 issued in the corresponding Japanese Patent Application No. 2006-066143 and English-language translation.

Supplementary European Search Report dated Sep. 12, 2011 issued in the corresponding European Patent Application No. 077151.9-1256/1995197.

* cited by examiner

SHEET INVERTING AND CONVEYING MECHANISM AND SHEET INVERTING AND CONVEYING APPARATUS

TECHNICAL FIELD

The invention of the present application relates to a sheet inverting and conveying mechanism for inverting and conveying a sheet in an image forming apparatus such as a printing press or a copier, and to a sheet inverting and conveying apparatus including such a sheet inverting and conveying mechanism.

BACKGROUND ART

Techniques for inverting the obverse and reverse sides of sheets while conveying the sheets have been disclosed in Patent Documents 1 to 3, for example. In any of these techniques, there is provided a mechanism including both of a member that comes into contact with the obverse side of a sheet being conveyed, and a member that comes into contact with the reverse side thereof. Such contact members include a guide member, a conveying roller, a conveying belt and the like in a conveying direction.

Patent Document 1: Japanese Examined Patent Application Publication No. 60-45097

Patent Document 2: Japanese Unexamined Patent Application Publication No. 2004-43111

Patent Document 3: Japanese Unexamined Patent Application Publication No. 2005-29375

DISCLOSURE OF THE INVENTION

Problems to be Solved by the Invention

Actually, in a double-sided printing press in general, one side of a sheet is first printed, the sheet is subsequently inverted, and the other side of the sheet is then printed. When such a double-sided printing operation is carried out by using the mechanisms of Patent Documents 1 to 3, one side of a sheet, which has been printed, comes into contact with a contact member such as a conveying roller, and ink that has not been sufficiently dried yet rubs against the contact member, resulting in a problem that smudges are created in the printing on one side of the sheet. It should be noted that measures to perform, for example, a process for making the contact member ink-repellent may be taken, but under present circumstances, it falls short of completely eliminating smudges in the printing on a sheet.

Further, the mechanisms of Patent Documents 1 to 3 each requires the size of a section thereof for inverting a sheet to be at least equal to or greater than the longitudinal dimension of the sheet. Accordingly, an apparatus including such a mechanism has been increased in size.

An object of the invention of the present application is to provide a sheet inverting and conveying mechanism and a sheet inverting and conveying apparatus including the mechanism, which are capable of preventing printing smudges from being created by a contact member, and also capable of achieving size reduction.

Solution to the Problems

A first invention of the present application provides a sheet inverting and conveying mechanism for conveying a sheet in a first direction, for inverting obverse and reverse sides of the sheet, and for conveying the inverted sheet in a second direction, the mechanism characterized by including: a first conveyance section for receiving, at its conveyance face, one side of the sheet, and for conveying the sheet in the first direction; a sheet inverting section for receiving, at its bent inner peripheral face, said one side of the sheet, and for inverting the sheet while bending the sheet along the bent inner peripheral face; and a second conveyance section for receiving, at its conveyance face, said one side of the inverted sheet, and for conveying the sheet in the second direction, wherein the first conveyance section and the second conveyance section are formed so that the sheet is conveyed while being attracted to the conveyance faces.

The above-described first invention preferably adopts the following structure(s).

(1) The sheet inverting section is formed into a troughed body including the bent inner peripheral face that is continuous.

(2) The sheet inverting section includes the bent inner peripheral face formed by providing a plurality of bent members in a grid pattern.

(3) The bent inner peripheral face of the sheet inverting section is defined by a bent direction thereof, and a widthwise direction thereof orthogonal to the bent direction, and the sheet inverting section is disposed in a positional relationship in which the widthwise direction of the bent inner peripheral face is allowed to intersect the first direction at a predetermined angle in plan view with respect to the conveyance face in the first direction.

(4) The bent inner peripheral face of the sheet inverting section is defined by a bent direction thereof, and a widthwise direction thereof orthogonal to the bent direction, and the sheet inverting section is disposed by setting a bent angle of the bent inner peripheral face in the bent direction to a predetermined angle in lateral view with respect to the conveyance faces in the first direction and the second direction.

A second invention of the present application provides a sheet inverting and conveying apparatus characterized by including the sheet inverting and conveying mechanism of the above-described first invention.

The above-described second invention preferably adopts the following structure.

(5) The apparatus includes a plurality of the sheet inverting and conveying mechanisms in combination so that the sheet is conveyed while being repeatedly inverted.

Effects of the Invention

In the above-described first invention, the sheet is conveyed and inverted while only one side thereof, received at the conveyance face of the first conveyance section, comes into contact with the first conveyance section, the sheet inverting section and the second conveyance section, i.e., without allowing the other side of the sheet to come into contact with them. Therefore, according to the present invention, the printing on the side, which has been printed first, can be prevented from being brought into contact with a member associated with the conveyance and/or inversion and from being smudged during a printing operation on both the sides.

Moreover, in the sheet inverting and conveying mechanism of the present invention, even if a plan view dimension and a height dimension of the sheet inverting section are both considerably smaller as compared with a longitudinal dimension of the sheet, the mechanism functions properly. Therefore, according to the present invention, size reduction can be achieved.

In the above-described structure (1), since the sheet inverting section can be formed by a troughed body, a simple structure can be realized.

In the above-described structure (2), the inside of the sheet inverting section can be easily checked through gaps of the grid.

In the above-described structure (3), the positional relationship of the second direction with respect to the first direction can be variously set. Specifically, (I) if the sheet inverting section is disposed in a positional relationship in which the widthwise direction of the bent inner peripheral face is allowed to intersect the first direction at an angle of 90 degrees in plan view with respect to the conveyance face in the first direction, the second direction can be set diametrically opposite to the first direction. (II) If the sheet inverting section is disposed in a positional relationship in which the widthwise direction of the bent inner peripheral face is allowed to intersect the first direction at any angle except 90 degrees in plan view with respect to the conveyance face in the first direction, the second direction can be set to an inclined direction with respect to the first direction in the above-described plan view.

In the above-described structure (4), the positional relationship of the second direction with respect to the first direction can be variously set. Specifically, (I) if the sheet inverting section is disposed by setting the bent angle of the bent inner peripheral face in the bent direction to an angle of 180 degrees in lateral view with respect to the conveyance faces in the first direction and the second direction, the second direction can be set in parallel with the first direction in the above-described lateral view. For example, if the first direction is a horizontal direction, the second direction is also a horizontal direction. (II) If the sheet inverting section is disposed by setting the bent angle of the bent inner peripheral face in the bent direction to any angle, which is greater than 90 degrees and smaller than 180 degrees, in lateral view with respect to the conveyance faces in the first direction and the second direction, the second direction can be set to an inclined direction with respect to the first direction in the above-described lateral view. For example, if the first direction is a horizontal direction, the second direction is an upwardly inclined direction with respect to the horizontal direction.

According to the above-described second invention, it is possible to realize the sheet inverting and conveying apparatus capable of achieving the effects of the sheet inverting and conveying mechanism of the above-described first invention.

In the above-described structure (5), for example, in a double-sided printing press, the sheet, on the obverse side of which a printing process has been performed by an obverse side printing section, can be conveyed to a reverse side printing section, located far from the obverse side printing section in a planar or three-dimensional sense, in the state in which only the reverse side is allowed to come into contact with the conveyance face of the conveyance section and the bent inner peripheral face of the sheet inverting section, i.e., without allowing the obverse side to come into contact with the conveyance face of the conveyance section and the bent inner peripheral face of the sheet inverting section. Accordingly, the printing on the obverse side can be prevented from being brought into contact with a member associated with the conveyance and/or inversion and from being smudged until a printing process is performed on the reverse side.

Moreover, the small sheet inverting and conveying mechanisms are combined in a compact manner, thus making it possible to realize the above-described effects. Accordingly, the small sheet inverting and conveying apparatus can be realized.

DESCRIPTION OF THE REFERENCE CHARACTERS

Figure 1:
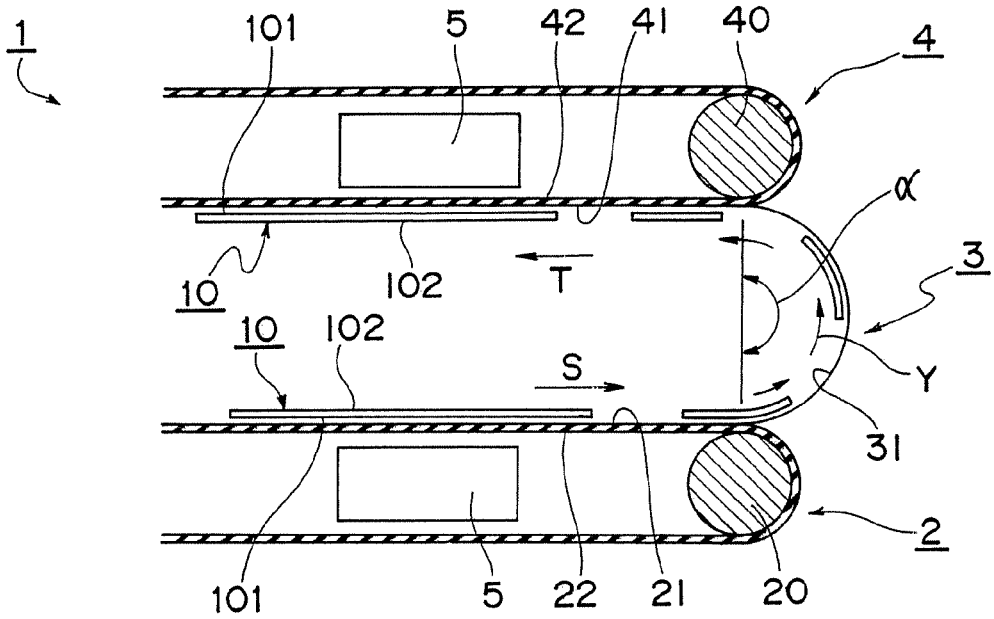
FIG. 1 is a schematic lateral cross-sectional view of a sheet inverting and conveying mechanism according to a first embodiment of a first invention of the present application.

1 sheet inverting and conveying mechanism
2 first conveyance section
21 conveyance face
3 sheet inverting section
31 bent inner peripheral face
4 second conveyance section
41 conveyance face
10 sheet
101 one side (reverse side)
102 other side (obverse side)

BEST MODE FOR CARRYING OUT THE INVENTION

[Sheet Inverting and Conveying Mechanism]

First Embodiment

Figure 2:
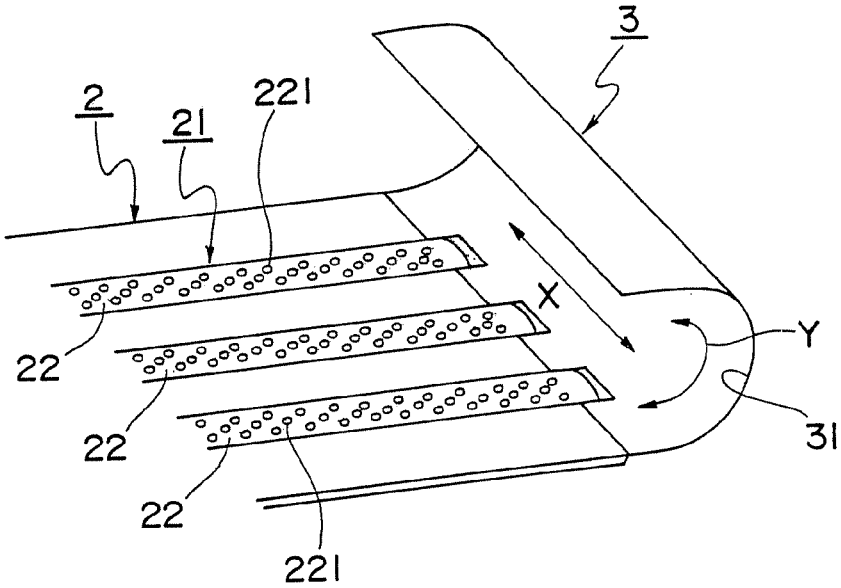
FIG. 2 is an upper perspective view of a first conveyance section and a sheet inverting section of the sheet inverting and conveying mechanism of FIG. 1.

FIG. 1 is a schematic lateral cross-sectional view of a sheet inverting and conveying mechanism according to a first embodiment of a first invention of the present application. The sheet inverting and conveying mechanism 1 includes a first conveyance section 2, a sheet inverting section 3, and a second conveyance section 4. FIG. 2 is an upper perspective view of the first conveyance section 2 and the sheet inverting section 3 of the sheet inverting and conveying mechanism 1 of FIG. 1.

The first conveyance section 2 is formed so as to receive, at its horizontal conveyance face 21, one side 101 of a sheet 10, and to convey the sheet 10 in a first direction (in the direction of an arrow S). The sheet inverting section 3 is formed so as to receive, at its bent inner peripheral face 31, one side 101 of the sheet 10, and to invert the sheet 10 while bending it along the bent inner peripheral face 31. The second conveyance section 4 is formed so as to receive, at its horizontal conveyance face 41, one side 101 of the inverted sheet 10, and to convey the sheet 10 in a second direction (in the direction of an arrow T).

In the first conveyance section 2, the conveyance face 21 includes upper faces of three endless annular conveying belts 22 spanning between two rollers 20. At the reverse side of the conveyance face 21, a suction device 5 is provided. The suction device 5 is formed so as to suck the sheet 10 on the conveyance face 21 via through holes 221 of the conveying belts 22, thereby attracting the sheet to the conveyance face 21. The conveyance face 21 is connected to a lower portion of the bent inner peripheral face 31 of the sheet inverting section 3.

In the sheet inverting section 3, as shown in FIG. 2, the bent inner peripheral face 31 is defined by: a bent direction Y; and a widthwise direction X orthogonal to the bent direction Y. Further, an open angle $\alpha$, i.e., a bent angle, of the bent inner peripheral face 31 in the center of the bending shown in FIG. 1 is 180 degrees. The sheet inverting section 3 is specifically formed into a troughed body including the bent inner peripheral face 31 that is continuous. An upper portion of the bent inner peripheral face 31 is connected to the conveyance face 41 of the second conveyance section 4.

The second conveyance section 4 is one provided by turning the first conveyance section 2 upside down. Specifically, the conveyance face 41 includes lower faces of three endless annular conveying belts 42 spanning between two rollers 40. Also in the second conveyance section 4, the sheet 10 is sucked by the suction device 5 via through holes of the conveying belts 42, thereby attracting the sheet to the conveyance face 41.

Figure 3:
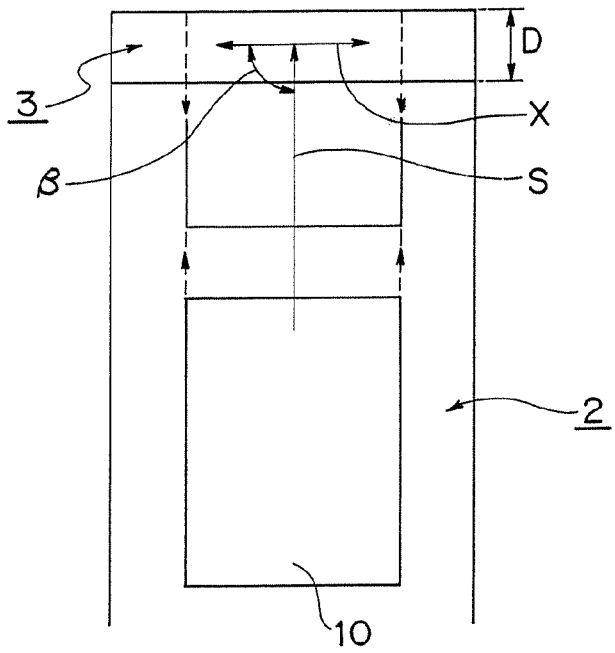
FIG. 3 is a schematic plan view of FIG. 2.

As shown in FIG. 3, the first direction of the first conveyance section 2 indicated by the arrow S is orthogonal to the widthwise direction of the sheet inverting section 3 indicated by the arrow X in plan view with respect to the conveyance face in the first direction (which will be hereinafter simply referred to as "in plan view"). In other words, an angle $\beta$ formed by both the directions on the left side in plan view is 90 degrees.

The sheet inverting and conveying mechanism 1 structured as described above is operated as follows.

First, in the first conveyance section 2, the sheet 10 is conveyed in the direction of the arrow S with the movement of the conveying belts 22 in a state in which one side 101 is attracted to the conveyance face 21, and is then fed to the sheet inverting section 3. Next, the sheet 10 fed to the sheet inverting section 3 is inverted while being bent along the bent inner peripheral face 31 as indicated by an arrow Y, corresponding to the conveying direction, in a state in which one side 101 comes into contact with the bent inner peripheral face 31, and is then fed in the direction of the arrow T. Thereafter, in the second conveyance section 4, the sheet 10, which has been inverted and fed, is conveyed in the direction of the arrow T with the movement of the conveying belts in a state in which one side 101 is attracted to the conveyance face 41. Accordingly, in the sheet inverting and conveying mechanism 1 structured as described above, the sheet 10, which has been conveyed in the direction of the arrow S, has its obverse and reverse sides inverted, and is then conveyed in the direction of the arrow T, which is diametrically opposite to the direction of the arrow S and in parallel to the direction of the arrow S in lateral view.

Therefore, in the sheet inverting and conveying mechanism 1 structured as described above, the sheet 10, which has been conveyed in the first direction, can be inverted, and can then be fed in the second direction, which is diametrically opposite to the first direction and in parallel to the first direction in lateral view with respect to the first direction and the second direction (which will be hereinafter simply referred to as "in lateral view"). In this embodiment, the second direction is horizontal.

Figure 4:
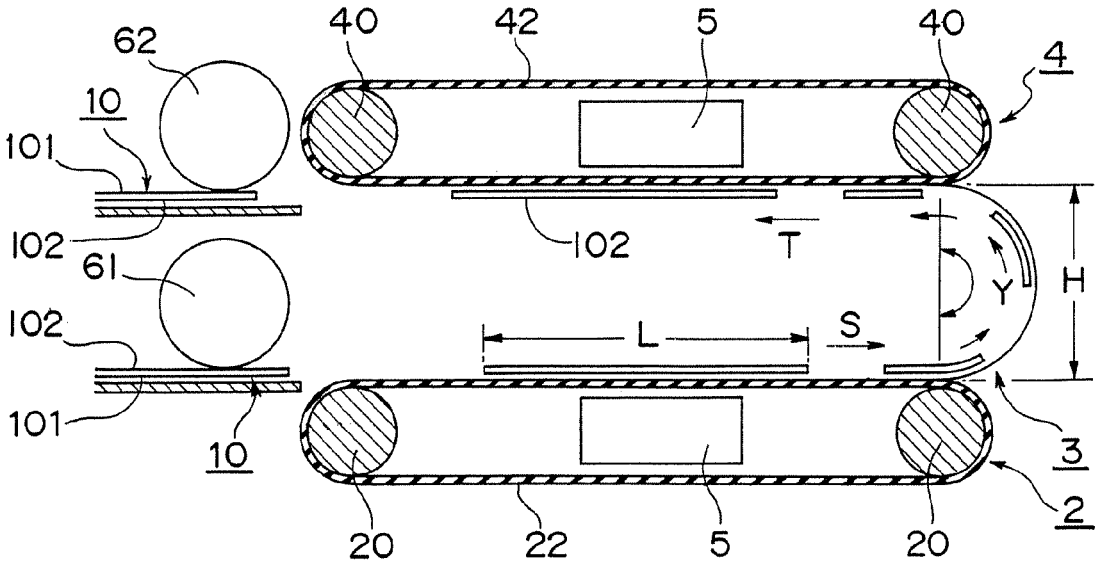
FIG. 4 is a schematic lateral cross-sectional view of one usage example of the sheet inverting and conveying mechanism of FIG. 1.

Furthermore, a obverse side printing section 61 for printing the other side (obverse side) 102 of the sheet 10 may be placed in a preceding stage of the first conveyance section 2, and a reverse side printing section 62 for printing one side (reverse side) 101 of the sheet 10 may be placed in a subsequent stage of the second conveyance section 4 as shown in FIG. 4, for example; in that case, in the sheet inverting and conveying mechanism 1 structured as described above, the sheet 10 is conveyed to the reverse side printing section 62 without allowing the obverse side 102 to come into contact with any of the first conveyance section 2, the sheet inverting section 3 and the second conveyance section 4 after the obverse side 102 has been printed. Accordingly, in the sheet inverting and conveying mechanism 1 structured as described above, the printing on the side, which has been printed first, can be prevented from being brought into contact with a member associated with the conveyance and/or inversion and from being smudged during a printing operation on both the sides.

Moreover, in the sheet inverting and conveying mechanism 1 structured as described above, even if a plan view dimension D (FIG. 3) and a height dimension H (FIG. 4) of the sheet inverting section 3 are both considerably smaller as compared with a longitudinal dimension L (FIG. 4) of the sheet 10, the sheet inverting section 3 functions to receive, at its bent inner peripheral face 31, one side 101 of the sheet 10, and to invert the sheet 10 while bending it along the bent inner peripheral face 31. Accordingly, in the sheet inverting and conveying mechanism 1 structured as described above, size reduction can be achieved.

Furthermore, in the sheet inverting and conveying mechanism 1 structured as described above, the sheet inverting section 3 can be formed by a troughed body, thus making it possible to realize a simple structure.

Second Embodiment

Figure 5:
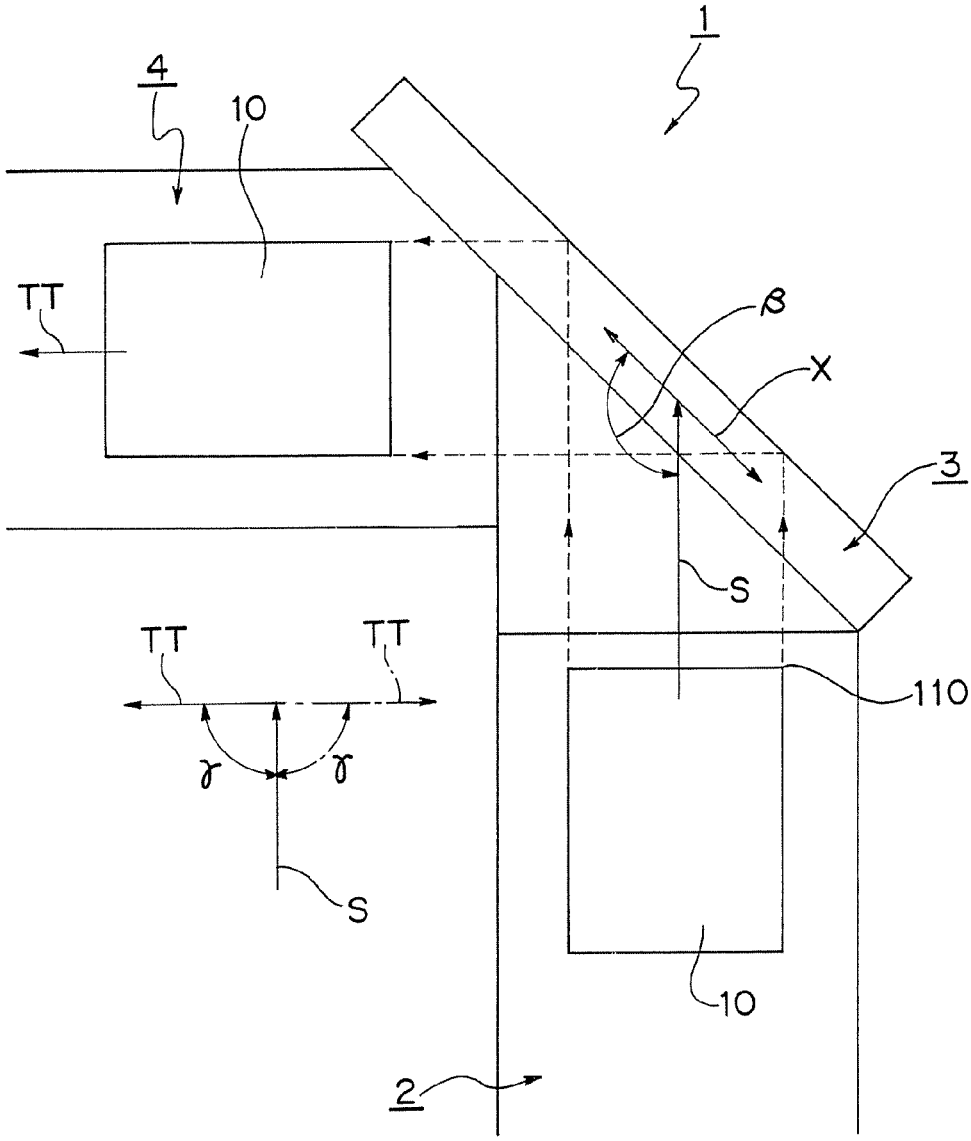
FIG. 5 is a schematic plan view of a sheet inverting and conveying mechanism according to a second embodiment of the present invention.

FIG. 5 is a schematic plan view of a sheet inverting and conveying mechanism according to a second embodiment of the present invention, which is equivalent to FIG. 3 of the first embodiment. In the present embodiment, an angle β formed by the first direction of the first conveyance section 2 indicated by the arrow S, and the widthwise direction of the sheet inverting section 3 indicated by the arrow X is set to 135 degrees. In this regard, the angle β in the first embodiment is 90 degrees. The other structures are similar to those of the first embodiment.

In the sheet inverting and conveying mechanism 1 of the present embodiment, the sheet 10, which has been conveyed and fed to the sheet inverting section 3 by the first conveyance section 2, is inverted while being bent along the bent inner peripheral face 31 in a state in which one side 101 comes into contact with the bent inner peripheral face 31; concurrently, the sheet is fed in the direction of an arrow TT that forms an angle γ leftward in plan view with respect to the direction of the arrow S. The angle γ is 90 degrees in this embodiment. It should be noted that when the sheet 10, conveyed by the first conveyance section 2, is fed to the sheet inverting section 3, a right end 110 thereof, which is located at a front edge in plan view, first comes into contact with the bent inner peripheral face 31. The other operations of the present embodiment are similar to those of the first embodiment.

Accordingly, in the first embodiment, the sheet 10, conveyed in the first direction, is inverted and fed in the second direction diametrically opposite to the first direction; whereas, in the sheet inverting and conveying mechanism 1 of the present embodiment, the sheet 10, conveyed in the first direction, can be inverted and fed in the second direction that forms the angle γ in plan view with respect to the first direction. In the present embodiment, since the angle β is 135 degrees, the angle γ is 90 degrees. It should be noted that the other effects of the present embodiment are similar to those of the first embodiment.

It should be noted that the angle β is not limited to 135 degrees. In other words, in the present embodiment, the angle β can be set to any angle which is greater than 0 degree and smaller than 180 degrees, thus making it possible to set the angle γ to any angle. For example, if the angle β is set to an angle that is greater than 90 degrees and smaller than 180 degrees, the angle γ, formed by the direction of the solid line arrow TT with respect to the direction of the arrow S shown in FIG. 5, can be set to any angle. For example, if the angle β is set to 120 degrees, the angle γ becomes 60 degrees. Furthermore, if the angle β is set to an angle that is greater than 0 degree and smaller than 90 degrees, the angle γ, formed by the direction of the dashed line arrow TT with respect to the direction of the arrow S shown in FIG. 5, can be set to any angle. The direction of the dashed line arrow TT extends rightward with respect to the direction of the arrow S.

Third Embodiment

Figure 6:
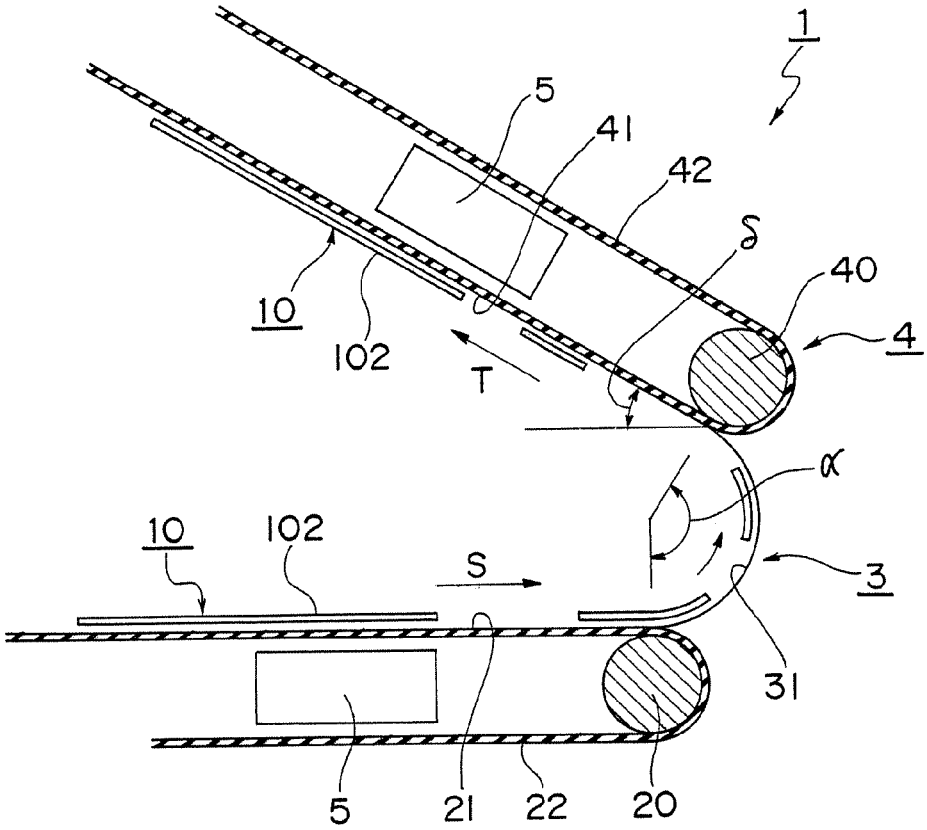
FIG. 6 is a schematic lateral cross-sectional view of a sheet inverting and conveying mechanism according to a third embodiment of the present invention, which is equivalent to FIG. 1.

FIG. 6 is a schematic lateral cross-sectional view of a sheet inverting and conveying mechanism according to a third embodiment of the present invention, which is equivalent to FIG. 1 of the first embodiment. In the present embodiment, a bent angle (angle α) of the bent inner peripheral face 31 of the sheet inverting section 3 is set to 150 degrees. In this regard, the angle α in the first embodiment is 180 degrees. The other structures of the present embodiment are similar to those of the first embodiment.

In the sheet inverting and conveying mechanism 1 of the present embodiment, the sheet 10, which has been conveyed and fed to the sheet inverting section 3 by the first conveyance section 2, is inverted while being bent along the bent inner peripheral face 31 in a state in which one side 101 comes into contact with the bent inner peripheral face 31; concurrently, the sheet is fed in the direction of the arrow T diametrically opposite to the direction of the arrow S. However, this direction of the arrow T is inclined upward by an angle δ in lateral view with respect to the direction of the arrow S. The angle δ is 30 degrees with respect to the horizontal plane in this embodiment. The other operations of the present embodiment are similar to those of the first embodiment.

Accordingly, in the first embodiment, the sheet 10, conveyed in the first direction, is inverted and fed in the second direction, which is diametrically opposite to the first direction and in parallel to the first direction in lateral view; whereas, in the sheet inverting and conveying mechanism 1 of the present embodiment, the sheet 10, conveyed in the first direction, can be inverted and fed in the second direction, which is diametrically opposite to the first direction and inclined upward by the angle δ in lateral view with respect to the first direction. In the present embodiment, since the angle α is 150 degrees, the angle δ is 30 degrees. It should be noted that the other effects of the present embodiment are similar to those of the first embodiment.

It should be noted that the angle α is not limited to 150 degrees. In other words, in the present embodiment, the angle α can be set to any angle that is greater than 90 degrees and smaller than 180 degrees; thus, the angle δ, formed by the direction of the arrow T with respect to the direction of the arrow S, can be set to any angle that is greater than 0 degree and smaller than 90 degrees. For example, if the angle α is set to 135 degrees, the angle δ becomes 45 degrees.

Other Embodiments (1) A structure including both of the structure of the second embodiment and the structure of the third embodiment may be adopted. Specifically, for example, the sheet inverting section 3 may be provided so that the angle β becomes 135 degrees and the angle α becomes 150 degrees. Thus, the sheet 10, conveyed in the first direction, can be inverted, and fed in the second direction, which forms an angle of 90 degrees in plan view with respect to the first direction and which is inclined upward by 30 degrees in lateral view with respect to the first direction.

(2) The first conveyance section and the second conveyance section may be formed so as to electrically charge the conveying belts with static electricity to attract and convey the sheet.

Figure 7:
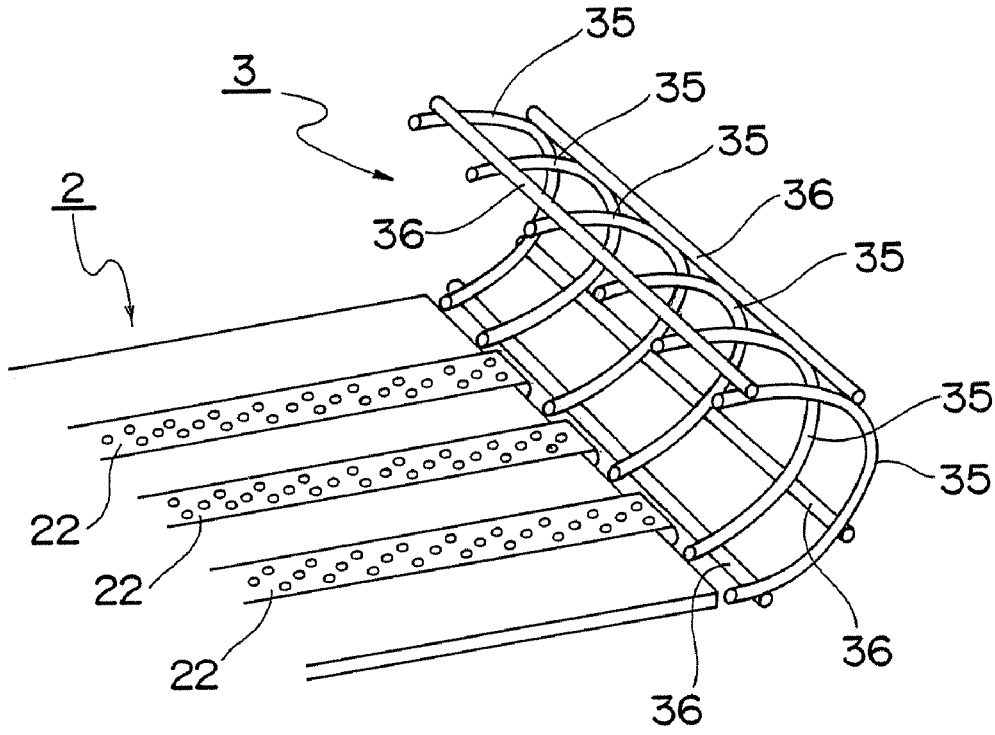
FIG. 7 is an upper perspective view showing another example of a bent inner peripheral face of the sheet inverting section.

(3) The bent inner peripheral face 31 of the sheet inverting section 3 may be formed by providing a plurality of bent members 35 along with transverse members 36 in a grid pattern as shown in FIG. 7, which is an upper perspective view of the sheet inverting section 3. Thus, the inside of the sheet inverting section 3 can be easily checked through gaps in the grid.

[Sheet Inverting and Conveying Apparatus]

First Embodiment

Figure 8:
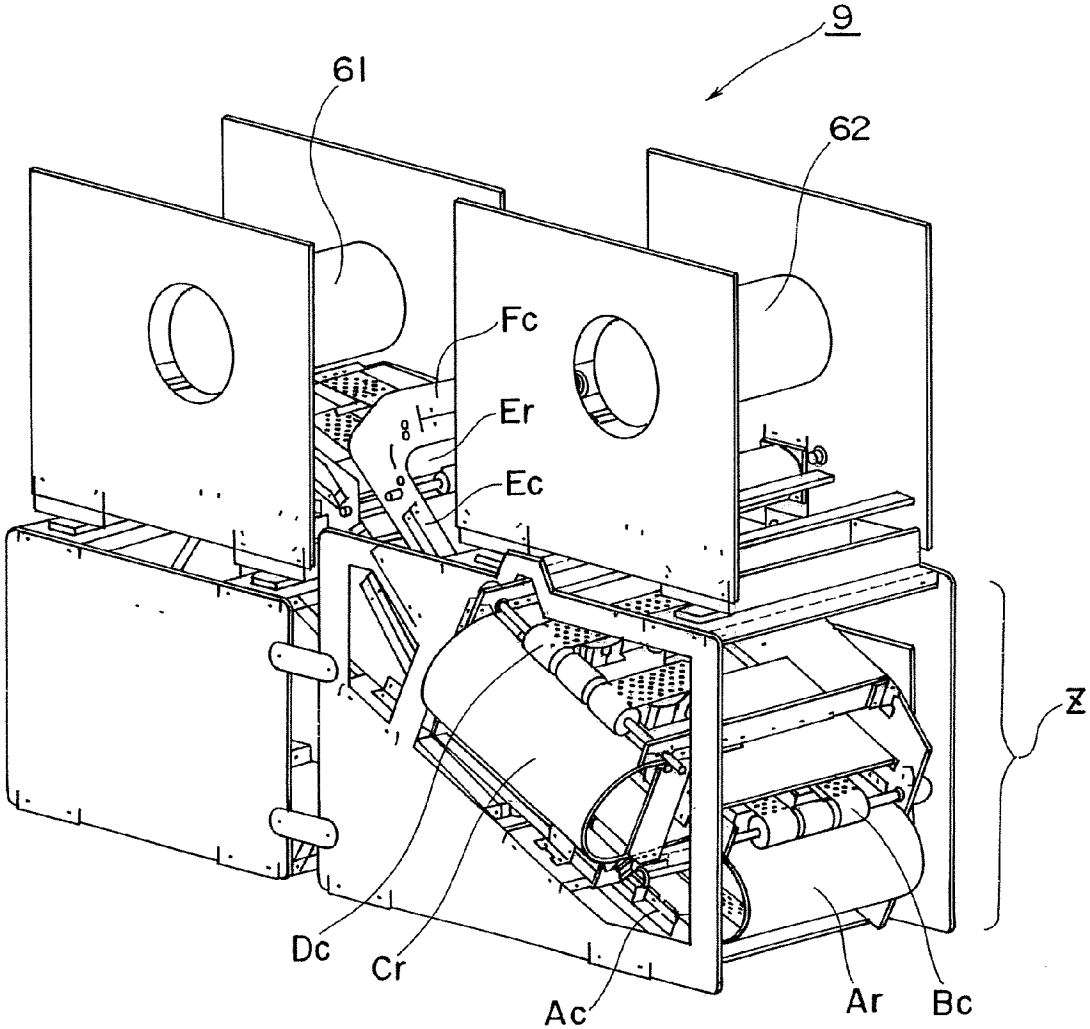
FIG. 8 is an upper perspective view of a sheet inverting and conveying apparatus according to a first embodiment of a second invention of the present application.
Figure 9:
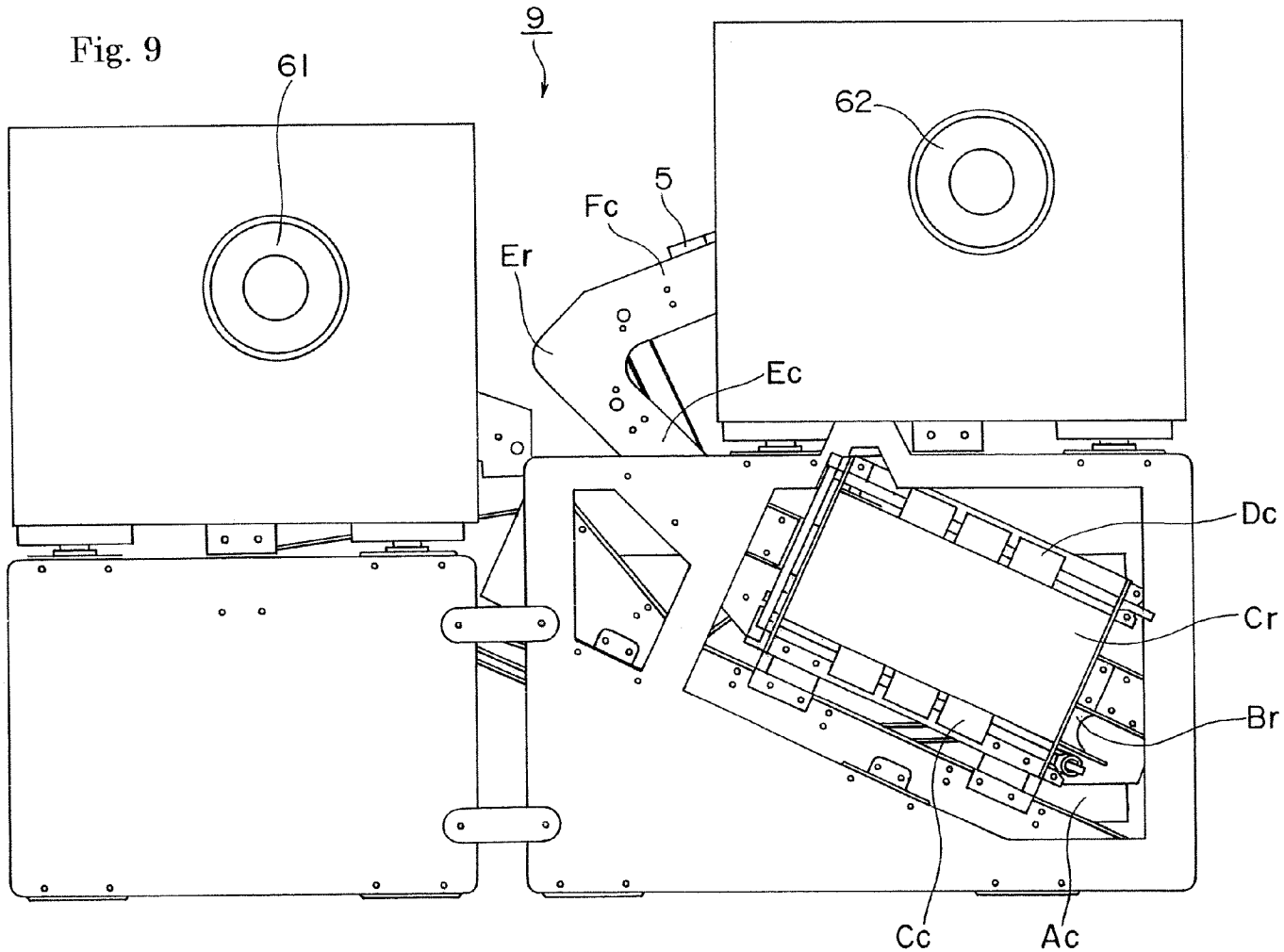
FIG. 9 is a lateral view of the sheet inverting and conveying apparatus according to the first embodiment of the present invention.

FIG. 8 is an upper perspective view of a sheet inverting and conveying apparatus according to a first embodiment of a second invention of the present application, and FIG. 9 is a lateral view of the apparatus. The apparatus 9 of the present embodiment includes five sheet inverting and conveying mechanisms. The apparatus 9 is formed so as to: convey a sheet, on which a printing process has been performed by a obverse side printing section 61, by a conveyance section Ac; invert the sheet by a sheet inverting section Ar; convey the sheet by a conveyance section Bc; invert the sheet by a sheet inverting section Br; convey the sheet by a conveyance section Cc; invert the sheet by a sheet inverting section Cr; convey the sheet by a conveyance section Dc; invert the sheet by a sheet inverting section Dr (not shown); convey the sheet by a conveyance section Ec; invert the sheet by a sheet inverting section Er; convey the sheet by a conveyance section Fc; and perform a printing process on the sheet by a reverse side printing section 62.

Furthermore, in the apparatus 9, a first sheet inverting and conveying mechanism is formed by the conveyance section Ac, the sheet inverting section Ar, and the conveyance section Bc, a second sheet inverting and conveying mechanism is formed by the conveyance section Bc, the sheet inverting section Br, and the conveyance section Cc, a third sheet inverting and conveying mechanism is formed by the conveyance section Cc, the sheet inverting section Cr, and the conveyance section Dc, a fourth sheet inverting and conveying mechanism is formed by the conveyance section Dc, the sheet inverting section Dr, and the conveyance section Ec, and a fifth sheet inverting and conveying mechanism is formed by the conveyance section Ec, the sheet inverting section Er, and the conveyance section Fc. In other words, the conveyance section Ac serves as a first conveyance section of the first sheet inverting and conveying mechanism, the conveyance section Bc serves as a second conveyance section of the first sheet inverting and conveying mechanism, and also serves as a first conveyance section of the second sheet inverting and conveying mechanism, the conveyance section Cc serves as a second conveyance section of the second sheet inverting and conveying mechanism, and also serves as a first conveyance section of the third sheet inverting and conveying mechanism, the conveyance section Dc serves as a second conveyance section of the third sheet inverting and conveying mechanism, and also serves as a first conveyance section of the fourth sheet inverting and conveying mechanism, the conveyance section Ec serves as a second conveyance section of the fourth sheet inverting and conveying mechanism, and also serves as a first conveyance section of the fifth sheet inverting and conveying mechanism, and the conveyance section Fc serves as a second conveyance section of the fifth sheet inverting and conveying mechanism. Further, the first and third sheet inverting and conveying mechanisms are each similar to the sheet inverting and conveying mechanism of the first embodiment of the present invention described above, the second and fourth sheet inverting and conveying mechanisms are each similar to the sheet inverting and conveying mechanism of the second embodiment of the present invention described above, and the fifth sheet inverting and conveying mechanism is similar to the sheet inverting and conveying mechanism of the third embodiment of the present invention described above.

Figure 10:
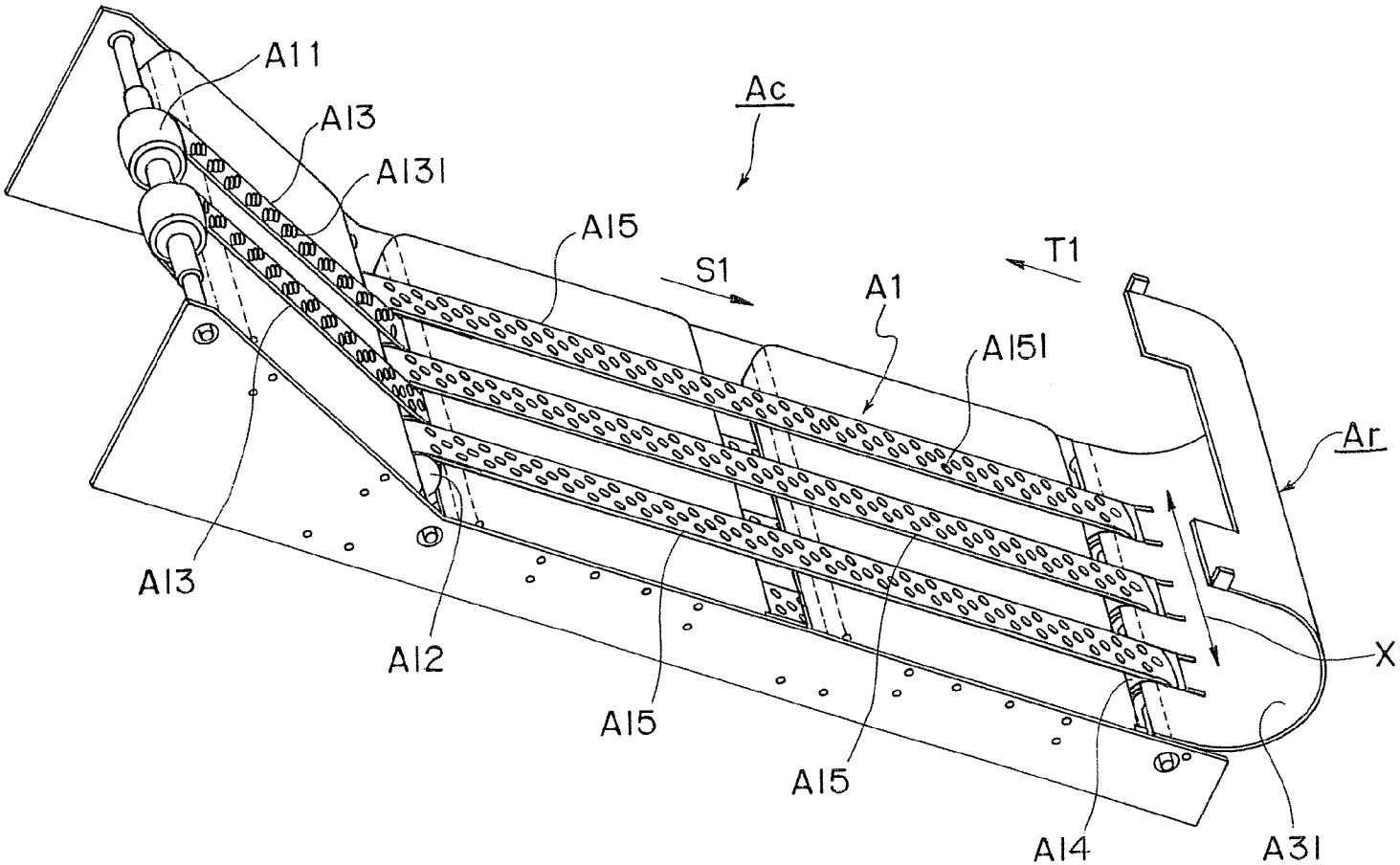
FIG. 10 is a perspective view of a conveyance section serving as a component of the sheet inverting and conveying apparatus according to the first embodiment.

FIG. 10 is a perspective view of the conveyance section Ac. The conveyance section Ac is formed by continuously disposing: two endless annular conveying belts A13 spanning between a conveying roller A11 and a conveying roller A12; and three endless annular conveying belts A15 spanning between the conveying roller A12 and a conveying roller A14. Furthermore, a conveyance face A1 is formed by upper faces of the conveying belts A13 and A15. The reverse side of the conveyance face A1, i.e., each of the reverse sides of the conveying belts A13 and A15, is provided with a suction device (not shown). This suction device is formed so as to suck the sheet via through holes A131 and A151 of the conveying belts A13 and A15, thereby attracting the sheet to the conveyance face A1. The conveyance section Ac is formed so as to convey the sheet in the direction of an arrow S1. The conveyance face A1 is connected to a lower portion of a bent inner peripheral face A31 of the sheet inverting section Ar.

The sheet inverting section Ar is disposed so that the widthwise direction of the bent inner peripheral face A31, indicated by an arrow X, is orthogonal to the direction of the arrow S1 in plan view. Accordingly, the sheet inverting section Ar is formed so as to invert the sheet, fed in the direction of the arrow S1, and feed the sheet in the direction of an arrow T1 diametrically opposite to the direction of the arrow S1.

Figure 11:
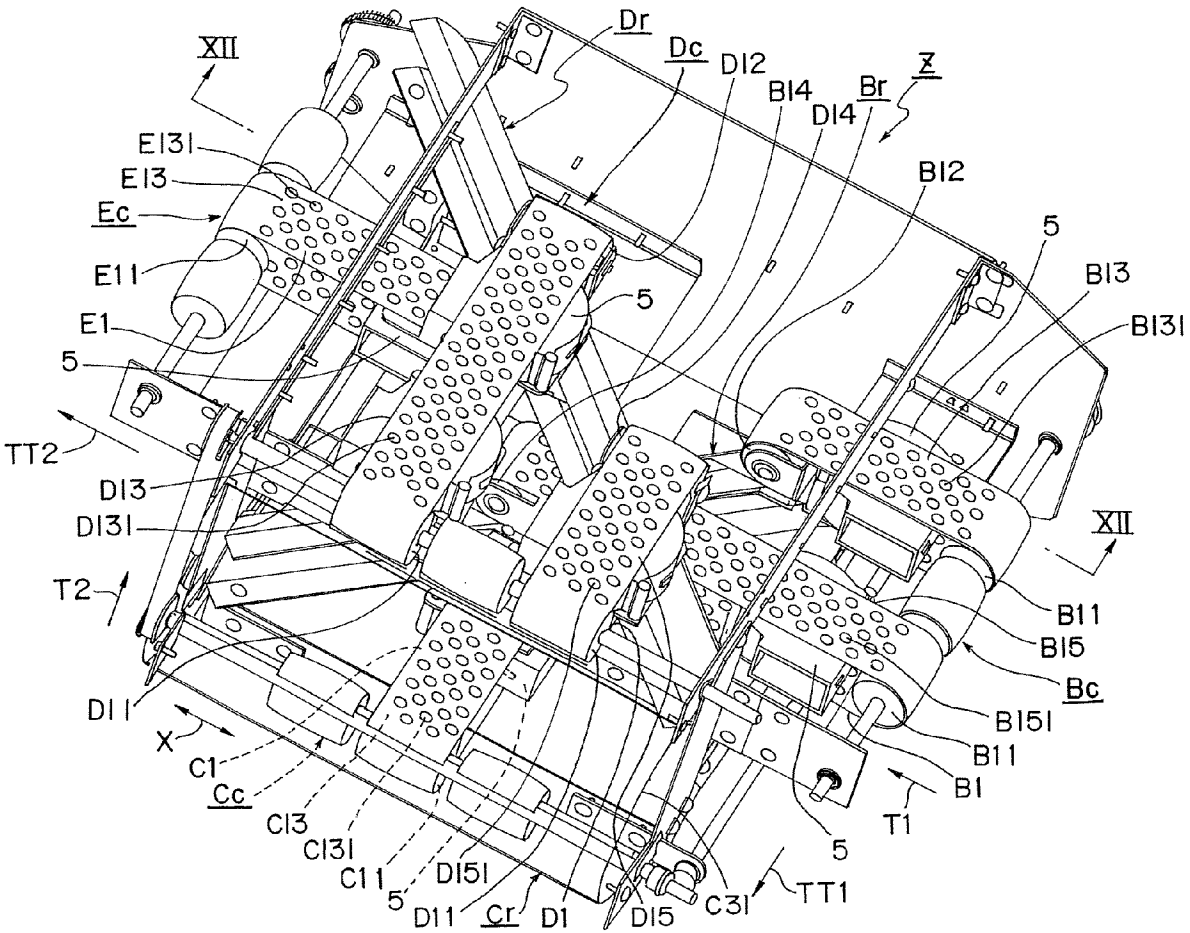
FIG. 11 is an upper perspective view of a portion of the sheet inverting and conveying apparatus according to the first embodiment.
Figure 12:
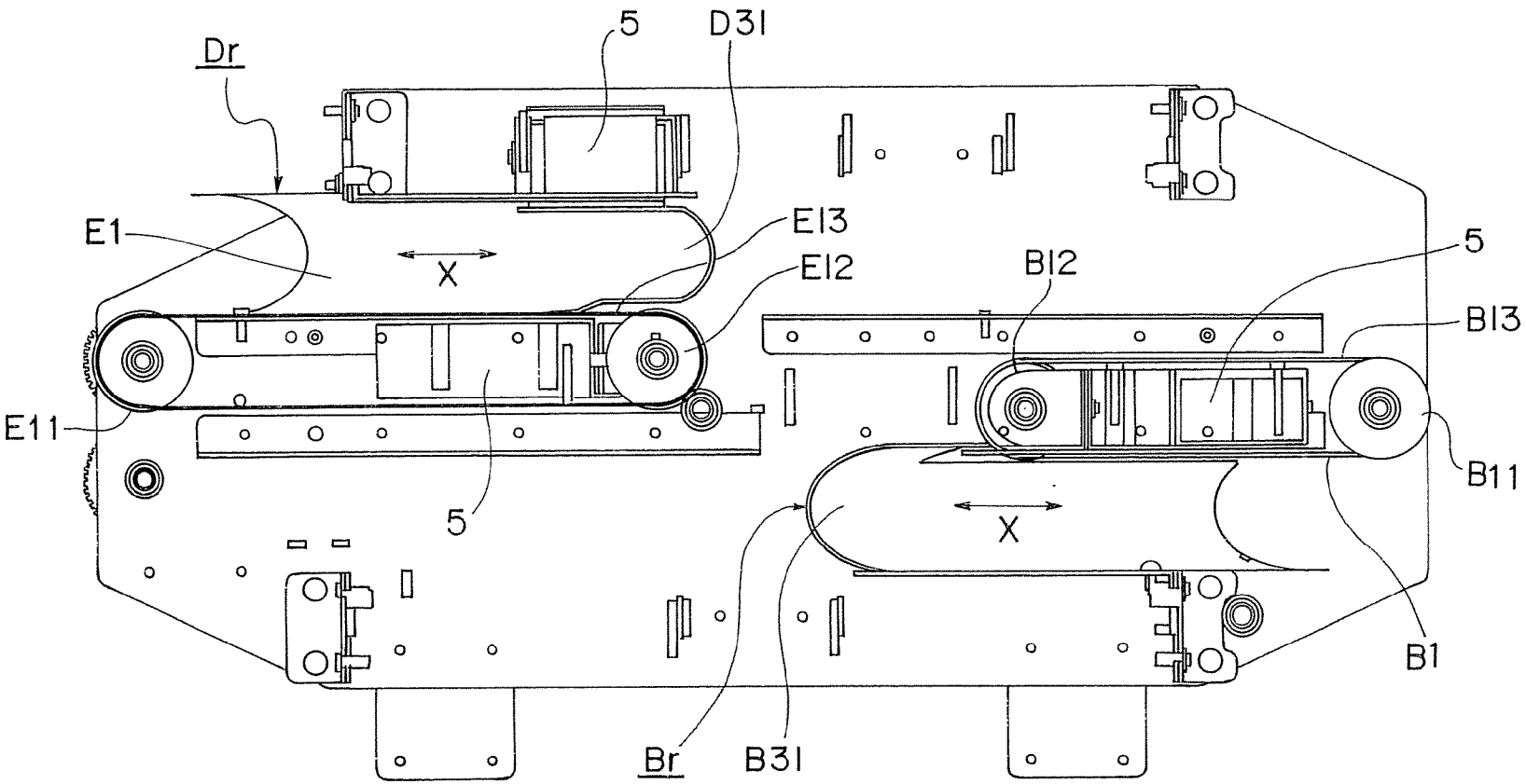
FIG. 12 is a cross-sectional view taken along XII-XII of FIG. 11.

FIG. 11 is an enlarged perspective view of a portion Z of the apparatus shown in FIG. 8, and FIG. 12 is a cross-sectional view taken along XII-XII of FIG. 11. In the portion Z, the conveyance section Bc, the sheet inverting section Br, the conveyance section Cc, the sheet inverting section Cr, the conveyance section Dc, the sheet inverting section Dr, and a part of the conveyance section Ec are three-dimensionally disposed.

The conveyance section Bc is formed by parallelly disposing: one endless annular conveying belt B13 spanning between a conveying roller B11 and a conveying roller B12; and one endless annular conveying belt B15 spanning between the conveying roller B11 and a conveying roller B14. Furthermore, a conveyance face B1 is formed by lower faces of the conveying belts B13 and B15. Each of the reverse sides of the conveying belts B13 and B15 is provided with a suction device 5. The suction device 5 is formed so as to suck the sheet via through holes B131 and B151 of the conveying belts B13 and B15, thereby attracting the sheet to the conveyance face B1. The conveyance section Bc is formed so as to convey the sheet in the direction of the arrow T1. The conveyance face B1 is connected to an upper portion of a bent inner peripheral face B31 of the sheet inverting section Br.

The sheet inverting section Br is disposed so that the widthwise direction thereof indicated by the arrow X forms an angle of 135 degrees on the left side in plan view with respect to the direction of the arrow T1. Accordingly, the sheet inverting section Br is formed so as to invert the sheet, fed in the direction of the arrow T1, and feed the sheet in the direction of an arrow TT1, which forms an angle of 90 degrees leftward in plan view with respect to the direction of the arrow T1.

The conveyance section Cc is formed by one endless annular conveying belt C13 spanning between a conveying roller C11 and a conveying roller (not shown). Furthermore, a conveyance face C1 is formed by an upper face of the conveying belt C13. The reverse side of the conveying belt C13 is provided with a suction device 5. The suction device 5 is formed so as to suck the sheet via through holes C131 of the conveying belt C13, thereby attracting the sheet to the conveyance face C1. The conveyance section Cc is formed so as to convey the sheet in the direction of the arrow TT1. The conveyance face C1 is connected to a lower portion of a bent inner peripheral face C31 of the sheet inverting section Cr.

The sheet inverting section Cr is disposed so that the widthwise direction thereof indicated by the arrow X is orthogonal to the direction of the arrow TT1 in plan view. Accordingly, the sheet inverting section Cr is formed so as to invert the sheet, fed in the direction of the arrow TT1, and feed the sheet in the direction of an arrow T2 diametrically opposite to the direction of the arrow TT1.

The conveyance section Dc is formed by parallelly disposing: one endless annular conveying belt D13 spanning between a conveying roller D11 and a conveying roller D12; and one endless annular conveying belt D15 spanning between the conveying roller D11 and a conveying roller D14. Furthermore, a conveyance face D1 is formed by lower faces of the conveying belts D13 and D15. Each of the reverse sides of the conveying belts D13 and D15 is provided with a suction device 5. The suction device 5 is formed so as to suck the sheet via through holes D131 and D151 of the conveying belts D13 and D15, thereby attracting the sheet to the conveyance face D1. The conveyance section Dc is formed so as to convey the sheet in the direction of the arrow T2. The conveyance face D1 is connected to an upper portion of a bent inner peripheral face D31 of the sheet inverting section Dr.

The sheet inverting section Dr is disposed so that the widthwise direction thereof indicated by the arrow X forms an angle of 135 degrees on the left side in plan view with respect to the direction of the arrow T2. Accordingly, the sheet inverting section Dr is formed so as to invert the sheet, fed in the direction of the arrow T2, and feed the sheet in the direction of an arrow TT2, which forms an angle of 90 degrees leftward in plan view with respect to the direction of the arrow T2.

Figure 13:
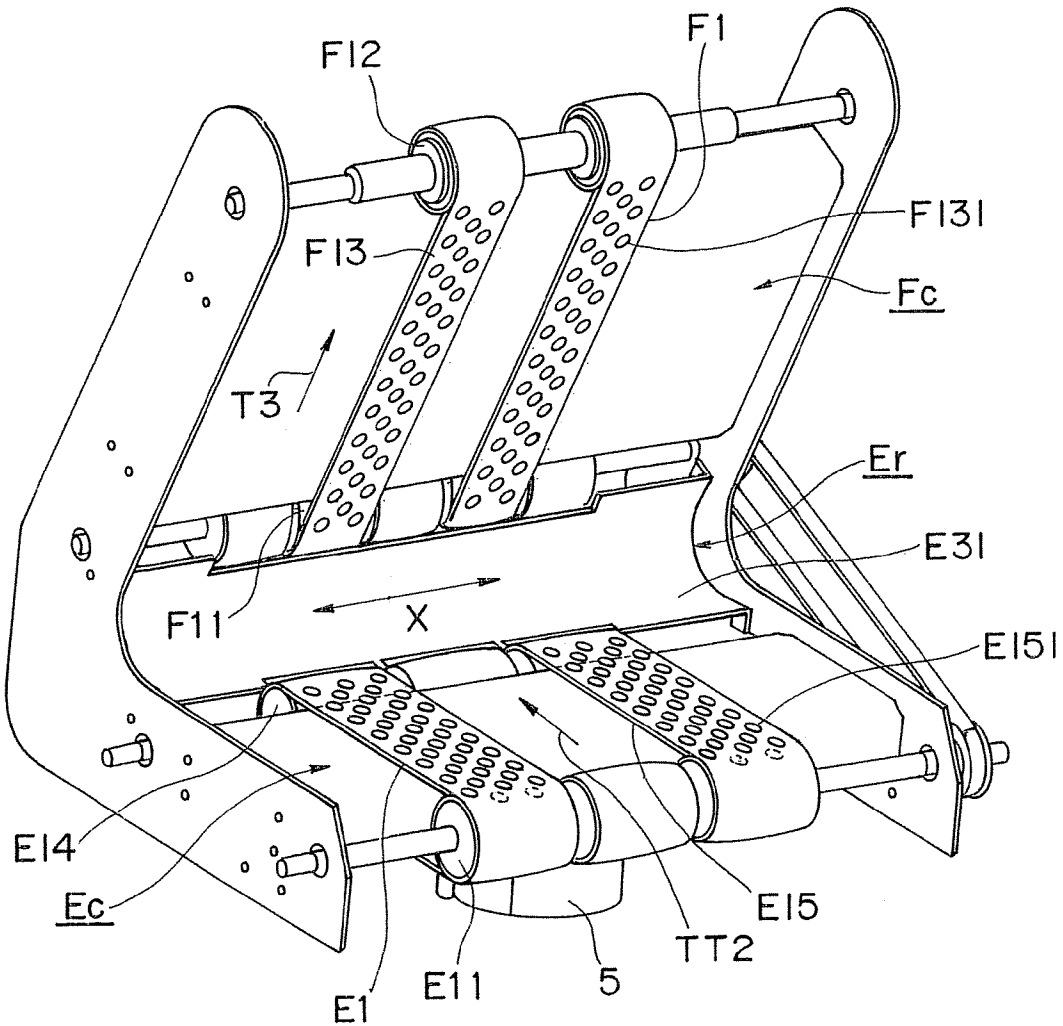
FIG. 13 is an upper perspective view of one sheet inverting and conveying mechanism of the sheet inverting and conveying apparatus according to the first embodiment.

FIG. 13 is an upper perspective view showing a part of the conveyance section Ec, the sheet inverting section Er and the conveyance section Fc. As shown in FIG. 11 and FIG. 13, the conveyance section Ec is formed by continuously disposing: one endless annular conveying belt E13 spanning between a conveying roller E11 and a conveying roller E12; and two endless annular conveying belts E15 spanning between the conveying roller E11 and a conveying roller E14. Furthermore, a conveyance face E1 is formed by upper faces of the conveying belts E13 and E15. Each of the reverse sides of the conveying belts E13 and E15 is provided with a suction device 5. The suction device 5 is formed so as to suck the sheet via through holes E131 and E151 of the conveying belts E13 and E15, thereby attracting the sheet to the conveyance face E1. The conveyance section Ec is formed so as to convey the sheet in the direction of the arrow TT2. The conveyance face E1 is connected to a lower portion of a bent inner peripheral face E31 of the sheet inverting section Er.

The sheet inverting section Er is disposed so that the widthwise direction thereof indicated by the arrow X is orthogonal to the direction of the arrow TT2 in plan view. Further, the bent inner peripheral face E31 of the sheet inverting section Er is set to a bent angle of 150 degrees. Accordingly, the sheet inverting section Er is formed so as to invert the sheet, fed in the direction of the arrow TT2, and feed the sheet in the direction of an arrow T3, which is diametrically opposite to the direction of the arrow TT2 and which is inclined upward by 30 degrees with respect to the conveyance face E1.

The conveyance section Fc is formed by two endless annular conveying belts F13 spanning between a conveying roller F11 and a conveying roller F12. Furthermore, a conveyance face F1 is formed by lower faces of the conveying belts F13. The reverse side of the conveying belt F13 is provided with a suction device 5 (FIG. 9). The suction device 5 is formed so as to suck the sheet via through holes F131 of the conveying belt F13, thereby attracting the sheet to the conveyance face F1. The conveyance section Fc is formed so as to convey the sheet in the direction of the arrow T3. The conveyance face F1 is connected to the reverse side printing section 62.

Figure 14:
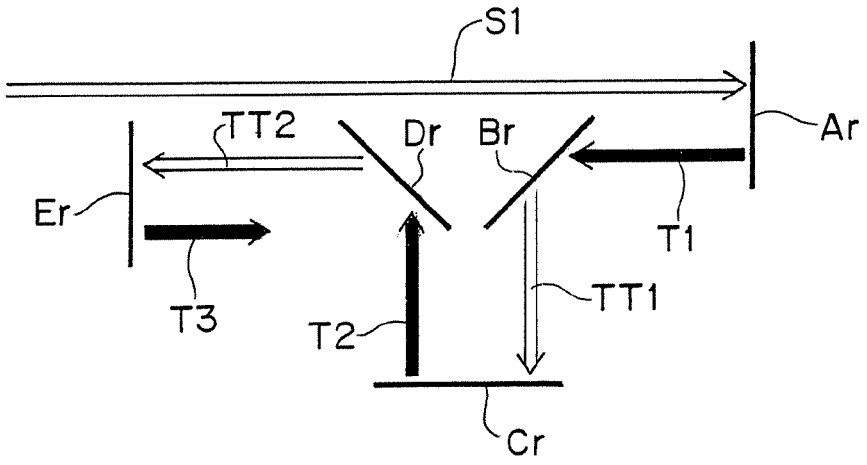
FIG. 14 is a diagram schematically showing an operation of the sheet inverting and conveying apparatus according to the first embodiment in plan view about only the conveying direction of a sheet and the state of obverse and reverse sides thereof.

FIG. 14 schematically shows an operation of the sheet inverting and conveying apparatus 9 structured as described above in plan view about only the conveying direction of a sheet and the state of obverse and reverse sides thereof. Further, FIG. 15 similarly shows the operation of the apparatus in lateral view. In both of the diagrams, white arrows and a white circle indicate the obverse state of the sheet, while black arrows and a black circle indicate the reverse state of the sheet. Furthermore, the white circle indicates the direction extending perpendicularly and frontward with respect to the diagram sheet, while the black circle indicates the direction extending perpendicularly and rearward with respect to the diagram sheet.

Figure 15:
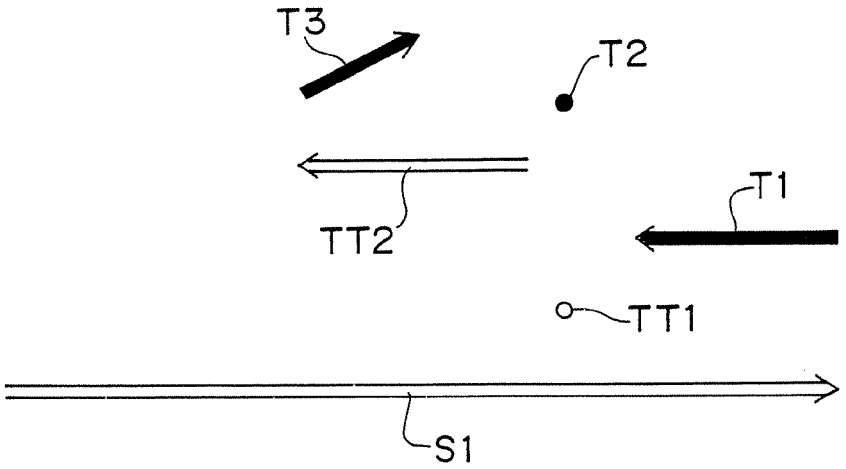
FIG. 15 is a diagram schematically showing an operation of the sheet inverting and conveying apparatus according to the first embodiment in lateral view about only the conveying direction of a sheet and the state of obverse and reverse sides thereof.

As shown in FIG. 14 and FIG. 15, in the apparatus 9, the sheet is: conveyed in the direction of the arrow S1 in the obverse state by the conveyance section Ac; inverted by the sheet inverting section Ar; conveyed in the direction of the arrow T1 in the reverse state by the conveyance section Bc; inverted by the sheet inverting section Br; conveyed in the direction of the arrow TT1 in the obverse state by the conveyance section Cc; inverted by the sheet inverting section Cr; conveyed in the direction of the arrow T2 in the reverse state by the conveyance section Dc; inverted by the sheet inverting section Dr; conveyed in the direction of the arrow TT2 in the obverse state by the conveyance section Ec; inverted by the sheet inverting section Er; and conveyed in the direction of the arrow T3 in the reverse state by the conveyance section Fc.

In the sheet inverting and conveying apparatus 9 structured as described above, the sheet, on the obverse side of which a printing process has been performed by the obverse side printing section 61, is conveyed to the reverse side printing section 62 in a state in which only the reverse side is allowed to come into contact with the conveyance face of the conveyance section and the bent inner peripheral face of the sheet inverting section, i.e., without allowing the obverse side to come into contact with the conveyance face of the conveyance section and the bent inner peripheral face of the sheet inverting section. Accordingly, in the apparatus 9, the printing on the obverse side can be prevented from being brought into contact with a member associated with the conveyance and/or inversion and from being smudged until a printing process is performed on the reverse side.

Moreover, in the sheet inverting and conveying apparatus 9 structured as described above, the five sheet inverting and conveying mechanisms are provided in a compact manner as shown in FIG. 11 in particular. Accordingly, the small sheet inverting and conveying apparatus can be realized between the obverse side printing section 61 and the reverse side printing section 62, which are far away from each other in plan view and/or in lateral view.

Other Embodiments

Figure 16:
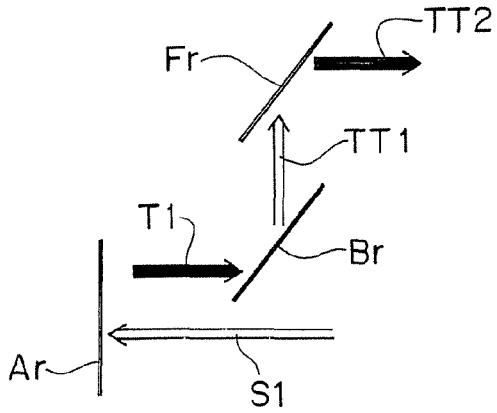
FIG. 16 is a diagram showing, in a manner similar to FIG. 14, a first exemplary operation of a sheet inverting and conveying apparatus according to another embodiment of the present invention.
Figure 17:
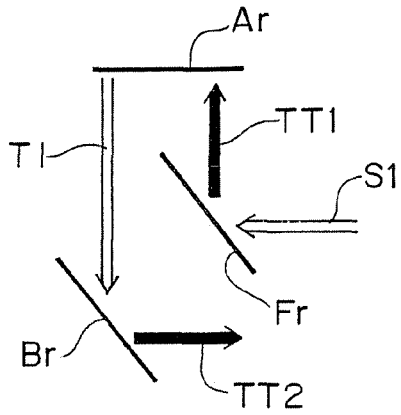
FIG. 17 is a diagram showing, in a manner similar to FIG. 14, a second exemplary operation of a sheet inverting and conveying apparatus according to another embodiment of the present invention.
Figure 18:
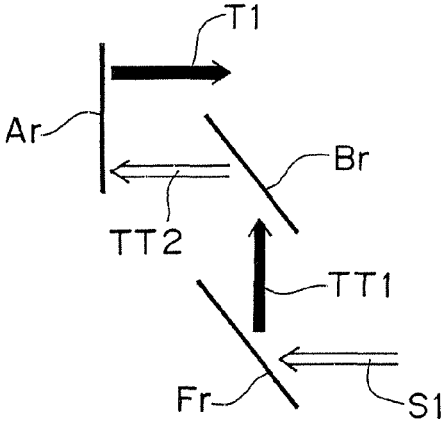
FIG. 18 is a diagram showing, in a manner similar to FIG. 14, a third exemplary operation of a sheet inverting and conveying apparatus according to another embodiment of the present invention.

The sheet inverting and conveying apparatus of the present invention may be formed by combining, in any order, three sheet inverting and conveying mechanisms, for example, so that it is operated as shown in FIG. 16 through FIG. 21, each of which is equivalent to FIG. 14. FIG. 16 through FIG. 18 each show a combination in which the initial and final conveying directions are diametrically opposite to each other, while FIG. 19 through FIG. 21 each show a combination in which the initial and final conveying directions are similar directions. It should be noted that each of the apparatuses of FIG. 16 through FIG. 21 uses at least two kinds of the following three kinds of the sections: the sheet inverting sections Ar and Br of the first embodiment, and a sheet inverting section Fr. The sheet inverting section Fr has a mirror-image relationship with the sheet inverting section Br.

(1) In the apparatus shown in FIG. 16, the three sheet inverting sections are disposed in the following order: Ar, Br, and Fr. Accordingly, in this apparatus, the sheet, conveyed in the direction of the arrow S1, is inverted, conveyed in the diametrically opposite direction of the arrow T1, inverted, conveyed in the direction of the arrow TT1 that forms an angle of 90 degrees leftward in plan view with respect to the direction of the arrow T1, inverted, and then conveyed in the direction of the arrow TT2 that forms an angle of 90 degrees rightward in plan view with respect to the direction of the arrow TT1. The direction of the arrow S1 and the direction of the arrow TT2 are diametrically opposite to each other.

(2) In the apparatus shown in FIG. 17, the three sheet inverting sections are disposed in the following order: Fr, Ar, and Br. Accordingly, in this apparatus, the sheet, conveyed in the direction of the arrow S1, is inverted, conveyed in the direction of the arrow TT1 that forms an angle of 90 degrees rightward in plan view with respect to the direction of the arrow S1, inverted, conveyed in the direction of the arrow T1 diametrically opposite to the direction of the arrow TT1, inverted, and then conveyed in the direction of the arrow TT2 that forms an angle of 90 degrees leftward in plan view with respect to the direction of the arrow T1. The direction of the arrow S1 and the direction of the arrow TT2 are diametrically opposite to each other.

(3) In the apparatus shown in FIG. 18, the three sheet inverting sections are disposed in the following order: Fr, Br, and Ar. Accordingly, in this apparatus, the sheet, conveyed in the direction of the arrow S1, is inverted, conveyed in the direction of the arrow TT1 that forms an angle of 90 degrees rightward in plan view with respect to the direction of the arrow S1, inverted, conveyed in the direction of the arrow TT2 that forms an angle of 90 degrees leftward in plan view with respect to the direction of the arrow TT1, inverted, and then conveyed in the direction of the arrow T1 diametrically opposite to the direction of the arrow TT2. The direction of the arrow S1 and the direction of the arrow T1 are diametrically opposite to each other.

Figure 19:
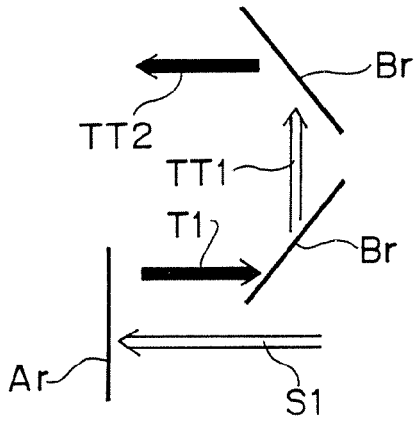
FIG. 19 is a diagram showing, in a manner similar to FIG. 14, a fourth exemplary operation of a sheet inverting and conveying apparatus according to another embodiment of the present invention.

(4) In the apparatus shown in FIG. 19, the three sheet inverting sections are disposed in the following order: Ar, Br, and Br. Accordingly, in this apparatus, the sheet, conveyed in the direction of the arrow S1, is inverted, conveyed in the diametrically opposite direction of the arrow T1, inverted, conveyed in the direction of the arrow TT1 that forms an angle of 90 degrees leftward in plan view with respect to the direction of the arrow T1, inverted, and then conveyed in the direction of the arrow TT2 that forms an angle of 90 degrees leftward in plan view with respect to the direction of the arrow TT1. The direction of the arrow S1 and the direction of the arrow TT2 are similar.

Figure 20:
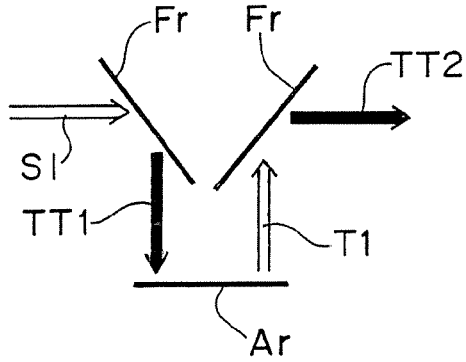
FIG. 20 is a diagram showing, in a manner similar to FIG. 14, a fifth exemplary operation of a sheet inverting and conveying apparatus according to another embodiment of the present invention.

(5) In the apparatus shown in FIG. 20, the three sheet inverting sections are disposed in the following order: Fr, Ar, and Fr. Accordingly, in this apparatus, the sheet, conveyed in the direction of the arrow S1, is inverted, conveyed in the direction of the arrow TT1 that forms an angle of 90 degrees rightward in plan view with respect to the direction of the arrow S1, inverted, conveyed in the direction of the arrow T1 diametrically opposite to the direction of the arrow TT1, inverted, and then conveyed in the direction of the arrow TT2 that forms an angle of 90 degrees rightward in plan view with respect to the direction of the arrow T1. The direction of the arrow S1 and the direction of the arrow TT2 are similar.

Figure 21:
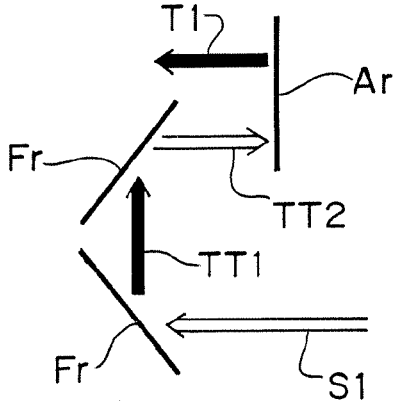
FIG. 21 is a diagram showing, in a manner similar to FIG. 14, a sixth exemplary operation of a sheet inverting and conveying apparatus according to another embodiment of the present invention.

(6) In the apparatus shown in FIG. 21, the three sheet inverting sections are disposed in the following order: Fr, Fr, and Ar. Accordingly, in this apparatus, the sheet, conveyed in the direction of the arrow S1, is inverted, conveyed in the direction of the arrow TT1 that forms an angle of 90 degrees rightward in plan view with respect to the direction of the arrow S1, inverted, conveyed in the direction of the arrow TT2 that forms an angle of 90 degrees rightward in plan view with respect to the direction of the arrow TT1, inverted, and then conveyed in the direction of the arrow T1 diametrically opposite to the direction of the arrow TT2. The direction of the arrow S1 and the direction of the arrow T1 are similar.

It should be noted that the kind and number of the sheet inverting sections to be combined are not limited to the above-described cases. It should be noted that in the sheet inverting and conveying mechanism of the second embodiment of the first invention, if the angle β differs, the kind of the sheet inverting section differs, and in the sheet inverting and conveying mechanism of the third embodiment of the first invention, if the angle α differs, the kind of the sheet inverting section differs.

Furthermore, the sheet inverting and conveying apparatus of the second invention not only includes the case where a plurality of the sheet inverting and conveying mechanisms of the first invention are provided, but also includes the case where only one sheet inverting and conveying mechanism of the first invention is provided.

INDUSTRIAL APPLICABILITY

The present invention can provide the sheet inverting and conveying mechanism capable of preventing printing smudges from being created by a contact member, and is Thus industrially highly valuable.

What is claimed is:

1. A sheet inverting and conveying apparatus comprising a plurality of sheet inverting and conveying mechanisms, in which each of said plurality of mechanisms conveys a sheet in a first direction, inverts obverse and reverse sides of the sheet, and then conveys the inverted sheet in a second direction, each of said plurality of mechanisms comprising:

a first conveyance section for receiving, at its conveyance face, the reverse side of the sheet, on the obverse side of which a printing process has been performed, and for conveying the sheet in the first direction;

a sheet inverting section for receiving, at its bent inner peripheral face, said reverse side of the sheet, and for inverting the sheet while bending the sheet along the bent inner peripheral face; and a second conveyance section for receiving, at its conveyance face, said reverse side of the inverted sheet, and for conveying the sheet in the second direction, wherein the first conveyance section and the second conveyance section are formed so that the sheet is conveyed while being attracted to the conveyance faces, wherein said mechanisms are in combination so that the sheet is conveyed while being repeatedly inverted and the sheet is conveyed in a state in which only the reverse side is allowed to come into contact with the conveyance face of the conveyance section and the bent inner peripheral face of the sheet inverting section, and wherein, in said combination, the second conveyance section of the preceding mechanism serves as the first conveyance section of the subsequent mechanism.

2. The sheet inverting and conveying apparatus according to claim 1, wherein the sheet inverting section is formed into a troughed body comprising the bent inner peripheral face that is continuous.

3. The sheet inverting and conveying apparatus according to claim 1, wherein the sheet inverting section comprises the bent inner peripheral face formed by providing a plurality of bent members in a grid pattern.

4. The sheet inverting and conveying apparatus according to claim 1, wherein the bent inner peripheral face of the sheet inverting section is defined by a bent direction thereof, and a widthwise direction thereof orthogonal to the bent direction, and wherein the sheet inverting section is disposed in a positional relationship in which the widthwise direction of the bent inner peripheral face is allowed to intersect the first direction at a predetermined angle in plan view with respect to the conveyance face in the first direction.

5. The sheet inverting and conveying apparatus according to claim 4, wherein said predetermined angle is greater than 0 degrees and smaller than 180 degrees, and is not 90 degrees.

6. The sheet inverting and conveying apparatus according to claim 1, wherein the bent inner peripheral face of the sheet inverting section is defined by a bent direction thereof, and a widthwise direction thereof orthogonal to the bent direction, and wherein the sheet inverting section is disposed by setting a bent angle of the bent inner peripheral face in the bent direction to a predetermined angle in lateral view with respect to the conveyance faces in the first direction and the second direction.

7. The sheet inverting and conveying apparatus according to claim 6, wherein said predetermined angle is greater than 90 degrees and smaller than 180 degrees.

* * * * *